US009982974B1

(12) United States Patent
McGaha

(10) Patent No.: US 9,982,974 B1
(45) Date of Patent: May 29, 2018

(54) COLLAPSIBLE ARROW

(71) Applicant: Michael L. McGaha, Brigham City, UT (US)

(72) Inventor: Michael L. McGaha, Brigham City, UT (US)

( * ) Notice: Subject to any disclaimer, the term of this patent is extended or adjusted under 35 U.S.C. 154(b) by 0 days. days.

(21) Appl. No.: 15/669,868

(22) Filed: Aug. 4, 2017

(51) Int. Cl.
*F42B 6/04* (2006.01)

(52) U.S. Cl.
CPC ..... *F42B 6/04* (2013.01)

(58) Field of Classification Search
CPC ..... F42B 6/04
USPC ..... 473/578
See application file for complete search history.

(56) References Cited

U.S. PATENT DOCUMENTS 1,613,360 A * 1/1927 Rigby ..... A63B 53/00 473/296
1,967,355 A * 7/1934 Edwards ..... A63B 53/14 280/823
3,759,519 A * 9/1973 Palma ..... F42B 6/04 30/162
4,722,531 A * 2/1988 Schram ..... F42B 6/02 403/343
4,772,029 A * 9/1988 Watkins ..... F42B 6/04 473/578
4,795,165 A * 1/1989 Tehan ..... F42B 6/04 473/578
5,823,902 A * 10/1998 Guest ..... F42B 6/06 473/578
6,678,989 B1 * 1/2004 Lowe ..... A01K 81/04 43/6
6,883,264 B1 * 4/2005 Gimbel ..... A01K 81/04 43/6
7,922,609 B1 * 4/2011 Hajari ..... F42B 12/362 473/578
8,376,882 B2 * 2/2013 Shaffer ..... F41B 5/1469 124/25
8,388,473 B2 * 3/2013 Smith ..... F42B 6/04 473/578
9,726,452 B1 * 8/2017 Pequeno-Gimenez . B26B 23/00
2008/0051231 A1 * 2/2008 Everett ..... F42B 12/362 473/578
2012/0149506 A1 * 6/2012 Connolly ..... F42B 6/04 473/578
2014/0256481 A1 * 9/2014 Flint ..... F42B 6/04 473/578

* cited by examiner

*Primary Examiner* — Alexander Niconovich
(74) *Attorney, Agent, or Firm* — Fehr Law Firm; Thompson E. Fehr

(57) ABSTRACT

A collapsible arrow having an outer shaft. An inner shaft is preferably in slidable contact with the outer shaft in order to aid longitudinal stability. In order to be shot with a bow, the inner shaft can be extended from the outer shaft; to be stored, the inner shaft can be retracted into the outer shaft. A locking mechanism having minimal aerodynamic impact holds the inner shaft in its maximum extend position for shooting and flight. Preferably, traditional aerodynamic stabilizers are located on the outer surface of the aft section of the inner shaft.

28 Claims, 6 Drawing Sheets

COLLAPSIBLE ARROW

BACKGROUND OF THE INVENTION

Field of the Invention

This invention relates to an arrow which can be collapsed for transportation and extended for shooting.

Description of the Related Art

Numerous patents exist for arrows which can be broken into separate sections and reassembled into a single arrow.

And U.S. Pat. No. 3,759,519 even involves an arrow having a cylindrical shaft section 26 which telescopes from a body portion 12. This arrow has, however, a construction which decreases stability and increases drag.

Lines 51 through 54 in column 2 of U.S. Pat. No. 3,759,519 explain, "The longitudinal cavity 16 of the body portion 12 is adapted to telescopically receive an arrow tip portion 13 comprised of a cylindrical shaft section 26 and a pointed tip 28." And lines 53 through 57 in column 4 add, "The arrow tip portion 13 and the body portion 12 are substantially of equal length so that, when the arrow tip portion 13 is telescoped within the body portion 12, the effective shooting length of the arrow will be approximately reduced by one-half . . . ." This means that, consistently with the depiction in FIG. 1 the rear end, which has the end flange 34, must be near the front end of the tubular body portion 12 when the arrow tip portion 13 has been extended into the shooting position.

And, according to lines 44 through 49 in column 2, "The body portion 12 has a longitudinal cavity 16 open at its front end 18 and closed at the rear end as at 20. The longitudinal bore 16 extends at the front end into an enlarged diameter portion 22 and at the rear end in a likewise enlarged diameter portion 24, which defines an energy storing chamber." The non-hash-marked area of the body portion 12 in FIGS. 1 and 3 emphasizes that the front end 18 is, indeed, open even when the arrow tip portion 13 is extended and thereby creates a concave passage to the direction of the arrow's flight, which one of ordinary skill in the art would understand creates more drag than does a closed surface in the direction of an arrow's flight.

Indeed, viewing FIGS. 1 through 4, it is clear, as it is from the preceding discussion, that the arrow tip portion 13 is never, especially when it is in the shooting position, in slidable contact with the body portion 12 around the longitudinal bore 16. The only support for the arrow tip portion 13, when it is in the shooting position is, as a matter of fact, provided by the two inclined resilient catch fingers 68, one each at the end of the oppositely disposed resilient detent means 64, removably inserted into the two rearwardly inclined oppositely disposed notches 30 and the fingers 74 of two opposite catch means 70, each being located ninety degrees from the inclined resilient catch fingers 68, removably inserted into the circumferential groove 32 at the rear end of the shaft section 26. The fact that the two opposite catch means 70 are located ninety degrees from the resilient catch finger 68 can be determined from [language and drawings] FIG. 1; FIG. 3; and lines 12 through 14 in column 4, which explain, " . . . a pair of releasable catch means 70 are provided, one of which is shown in a 90 degree offset position in dot-and-dash lines in FIG. 1.

Lines 47 through 49, 53 through 56, 59 through 60, and 61 through 63 in column 3 further describe the first means for maintaining the tip portion 13 in the extended position ready for shooting: "Referring back to FIG. 1, the arrow tip portion 13 is retained in the extended, ready position for shooting by a pair of oppositely disposed resilient detent means 64 . . . . Each of the resilient detent means is provided at its end with an inclined finger portion 68 which is inclined at the same angular degrees as the notches 30 on the shaft section 26 of the arrow tip portion 13 . . . . [T]he resilient finger portions 68 of the detent means 64 . . . will engage within a pair of oppositely disposed notches 30 on the shaft section 26 as illustrated in FIG. 1.

And lines 14 through 22 in column 4 further explain the second means for so maintaining the tip portion 13: "The catch means 70 comprises each a lever 72 pivoted inwardly of the cavity portion 22, each having a finger 74 at its inner end. The fingers 74 are adapted to snap into the groove 32 at the rear end of the shaft section 26 as the arrow tip portion 13 moves outwardly of the cavity 16 to engage behind the rear end flange 34 to thereby positively retain the arrow tip portion 13 against any further outward movement."

Then, in lines 43 through 47 of column 4, a discussion is presented concerning releasing these two maintaining means in order to permit the arrow tip portion 13 to move back into the body portion 12:

"After usage and retrieving of the arrow assembly 10, the arrow assembly 10 can be collapsed again by manipulation of the grip portions 78 of the catch means 70 and manual movement of the resilient catch finger 68 out of the notches 30 . . . ."

Lines 60 through 63 in column 1 seem to be referring to these two means for maintaining the tip portion 13 in the extended position ready for shooting when they say, "Resilient snap-over or manually releasable detent means are provided adjacent the open end of the tubular body portion of the arrow to rigidly retain the arrow tip portion in the extended ready position for shooting," since (1) the first such means, indeed, comprises resilient snap-over detents and (2) lines 44 through 46 in column 1 state, "Normally, the shaft section of the arrow tip portion is retained within the tubular body portion of the arrow by means of releasable detents or catch means . . . ," whereas lines 6 through 13 in column 3 as well as lines 14 through 22 in column 4 demonstrate that the second such means is virtually the same as the mentioned "releasable detents or catch means."

Although lines 8 through 14 in column 4 assert, " . . . [T]o provide sufficient axial rigidity to the extended arrow assembly and to prevent the arrow tip portion 13 from being completely moved out of the longitudinal cavity 16 of the body portion 12, a pair of releasable catch means 70 are provided . . . ," the support provided by the two inclined resilient catch fingers 68 of the oppositely disposed resilient detent means 64 removably inserted into the two rearwardly inclined oppositely disposed notches 30 (the first means for maintaining the tip portion 13 in the extended position ready for shooting) and the fingers 74 of two opposite catch means 70 removably inserted into the circumferential groove 32 at the rear end of the shaft section 26 (the first means for maintaining the tip portion 13 in the extended position ready for shooting) is inadequate to stabilize the longitudinal axis of the arrow tip portion 13 with respect to the longitudinal axis of the body portion 12.

Tolerances with regard to the two means for maintaining the tip portion 13 in the extended position ready for shooting cannot be strict since the fingers 68 of the oppositely disposed resilient detent means 64 must engage the two rearwardly inclined oppositely disposed notches 30 and the fingers 74 of two opposite catch means 70 must similarly engage the circumferential groove 32 when, according to lines 44 to 50 in column 1, the arrow tip portion 13 is extended from the body portion 12 either manually or through the use of an "energy storing means."

Confirming the lack of strict tolerances, FIG. 1 shows that the notches 30 have open ends; and "notch" is defined in *The American Heritage Dictionary of the English Language*, William Morris, editor; American Heritage Publishing Co., Inc. and Houghton Mifflin Company; Boston; copyright 1970; Library of Congress Catalog Card Number 76-86995, as "1. A V-shaped cut, especially one used for keeping count. 2. A narrow pass between mountains." Also, FIG. 1 shows that the ends of the notches 30 are open and that the finger 74 of a catch means 70 does not fill the entire circumferential groove 32 between the rear end flange 34 and the oppositely tapered groove 36. Moreover, lines 47 through 49 in column 3 indicate, " . . . the arrow tip portion 13 is retained in the extended, ready position for shooting by a pair of oppositely disposed resilient detent means 64 . . . ."; and lines 10 through 13 of column 4 explain, " . . . to prevent the arrow tip portion 13 from being completely moved out of the longitudinal cavity 16 of the body portion 12, a pair of releasable catch means 70 are provided . . . ." No restriction on movement of the arrow tip portion 13 in the pitch, roll, or yaw directions is either stated or shown. Thus, the fingers 68 of the oppositely disposed resilient detent means 64 can slide along notches 30, even past the open ends of the notches 30, as the finger 74 of one of the two opposite catch means 70 moves in the circumferential groove away from the rear end flange 34 toward the oppositely tapered groove 36, thereby causing the pointed tip 28 to tilt, in a plane containing the fingers 74 of the two opposite catch means 70, away from the finger 74 which had moved toward the oppositely tapered groove 36. Such finger 74 can then move away from the oppositely tapered groove 36, and the other finger 74 can move toward the oppositely tapered groove 36, thereby causing the fingers 68 to move in the opposite direction in the notches 30 to the direction which they had initially moved and tend to force the pointed tip 28 to reverse its direction of tilt and, ultimately, actually to reverse that direction of tilt.

Similarly, the absence of strict tolerances for the fingers 74 of the two opposite catch means 70 in the circumferential groove 32 enables the fingers 74 to rotate within the circumferential groove 32, thereby allowing the fingers 68 to move inward and outward within the notches 30 because of lax tolerances for dimensions of the fingers 68 and the notches 30. This permits the tip 28 to tilt back and forth in a plane containing the fingers 68 of the oppositely disposed resilient detent means 64. Even with strict tolerances, however, such tilting could occur because of the resilience of the resilient detent means 64.

A point 116, including a head 129 and a shoulder 130, using an insert 110, and a nock 136, with or without an insert 138, can be inserted into the first end 122 and the second end 138 of an arrow shaft 100, preferably an arrow shaft 100 having an outer metal concentric tube 104 and an inner fiber reinforced polymer tube 102, in the invention of U.S. Pat. No. 7,686,714; but no telescoping is present.

In U.S. Pat. No. 4,900,037 a sleeve 20 is located at the rear of an arrow 10; the sleeve 20 telescopes into a large sleeve 22 of the arrow. A compressible coil spring 30 located within the sleeve 20, and the large sleeve 22 is connected to the front of the large sleeve 22 and to the rear of the sleeve 20. Therefore, when a shooter releases the bow string 40, the bow string 40 pushes the nock 28, which is located at the rear of the sleeve 20. The spring 30 compresses, and the sleeve 22 enters the larger sleeve 20, which is located in the rear of the arrow shaft 14. The spring 30 expands to its full length shortly before the arrow 10 loses contact with the bow string 40. Sleeve 22, thus, enters the larger sleeve 20 only while the bow string 40 is accelerating the arrow; and sleeve 22 is never locked within sleeve 20.

In the case of U.S. Pat. No. 4,795,165 there is no real telescoping. Rear section 11 has a male forward end 15 to mate with the female tail end of the forward section 10. An elastic cord 16 attached to both sections 10, 11 keeps the sections 10, 11 together when they are separated and aids in connecting the two sections 10, 11.

And in the arrow of U.S. Pat. No. 4,722,531 the forward shaft portion 1 and the rearward shaft portion 9 just screw together. Again there is no telescoping.

The arrow 10 of U.S. Pat. No. 4,615,529 is similar to that of U.S. Pat. No. 4,795,165. There is no telescoping. Arrow 10 has a tubular mid-section 16. Forward section 14 and rear section 18 are partially received, in a similar fashion to the male end 15 of U.S. Pat. No. 4,795,165, within the tubular mid-section 16. An arrowhead 22 is attached to the forward section 14; a tail piece 26 with a laterally extending hook 30 is connected to the rear section 18. A flexible cord 20 is coiled inside the mid-section 16. The ends of the cord 20 are secured to the front section 14 and the rear section 18. When the arrow 10 strikes an animal, at least one of the front section 14 and the rear section 18 separates from the mid-section 16; the hook 30 snags tree branches or bushes, resulting in complete separation of the front section 14, the mid-section 16, and the rear section 18 if such separation has not already occurred; the cord 20 unrolls; and the hunter can follow the cord to the animal.

BRIEF SUMMARY OF THE INVENTION

The Collapsible Arrow comprises an outer shaft; an inner shaft, which is preferably in slidable contact with the outer shaft (to aid longitudinal stability), that, in order to be shot with a bow, can be extended from the outer shaft or, to be stored, can be retracted into the outer shaft. A locking mechanism, which preferably has little or no aerodynamic impact herein termed "minimal aerodynamic impact")—especially by being located solely within either or both of the outer shaft and the inner shaft, holds the inner shaft in its maximum extended position for shooting and flight.

The locking assembly provides further longitudinal stability, especially when there are two transversely opposed portions of the locking mechanism.

The present invention is much less complex than the arrow of U.S. Pat. No. 3,759,519 and, therefore, significantly less susceptible than the arrow of U.S. Pat. No. 3,759,519 to malfunctions caused by foreign particles such as dirt.

DETAILED DESCRIPTION OF THE INVENTION

Figure 1:
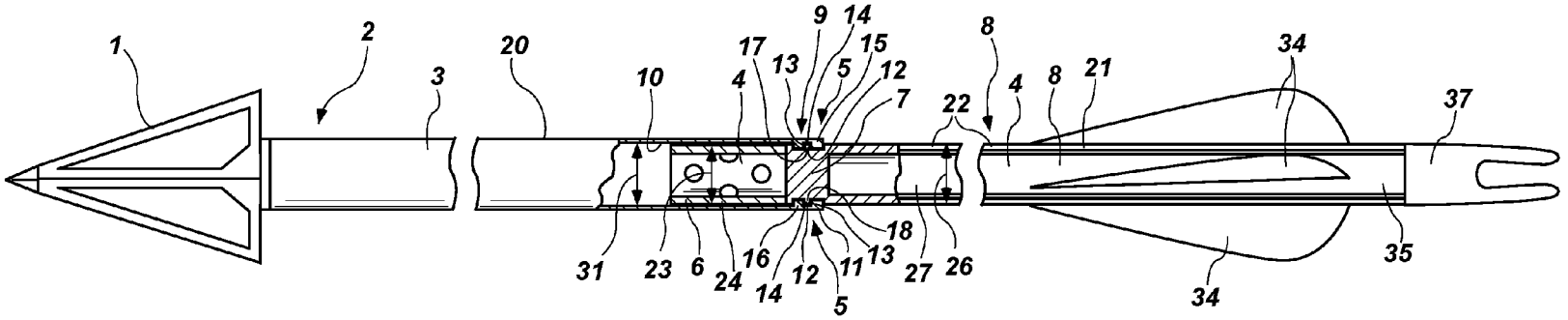
FIG. 1 is a cutaway lateral plan view of the Collapsible Arrow, which clearly to depict other elements does not portray the lug.
Figure 2:
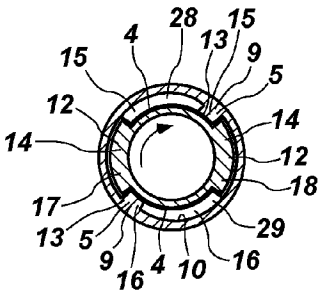
FIG. 2 is a plan view looking forward from the middle of the lug receptacle.
Figure 3:
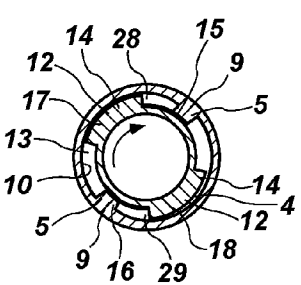
FIG. 3 is a plan view looking to the rear from the middle of the lug receptacle.

The present invention relates to a Collapsible Arrow which, as its name implies, may have its length shortened to facilitate storage and subsequently be re-extended and locked into position for use. The length is preferably in the range of traditional arrows but can be of any length that one of ordinary skill in the field would consider practical for shooting The preferred embodiment is shown in FIGS. 1 through 4 and comprises an arrow head 1 attached, preferably threadedly and adhesively, to a forward end 2 of a tube 3 designated the "arrow barrel" or "outer shaft"; an inner shaft 4; and a locking mechanism 5.

The inner shaft 4 comprises a forward section 6, an intermediate section 7, and an aft section 8. Most preferably, all the sections 6, 7, 8 are hollow. Optionally, however, any section 6, 7, 8 can be solid, although it is preferable, if only one section 6, 7, or 8 is hollow, that the forward section 6 and the intermediate section 7 are solid whereas the aft section 8 is preferably hollow. (And if a traditional nock 37 is employed, at least the free (rear) end 35 of the aft section 8 should be hollow frictionally to accommodate the forward end of a traditional nock 37. Of course, any technique known in the art can be utilized to attach the forward end of a traditional nock 37 to the free (rear) end 35 of the aft section 8.) As explained above and as shown in FIGS. 1, 2, 3, 4, 5, 7, 10, and 11, the inner shaft 4 can be retracted into the outer shaft 3 for more compact storage and extended from the outer shaft 3 for shooting. The locking mechanism 5 retains the inner shaft 4 in the shooting position.

The locking mechanism 5 can be comprised of any technology that will lock the position of the inner shaft with respect to the outer shaft without, when unlocked, obstructing any desired longitudinal movement of the inner shaft with respect to the outer shaft; preferably, such technology for the locking mechanism 5 will introduce minimal, and most preferably no, adverse aerodynamic effect. A description for the most preferred embodiment of the locking mechanism 5 begins in the very next paragraph.

A first portion 9 of the locking mechanism 5 is, as illustrated in FIGS. 1 through 4, attached to the inside 10 of the outer shaft 3, preferably near an aft end 11 of the outer shaft 3; and a mating portion 12 of the locking mechanism 5 is connected to the intermediate section 7 of the inner shaft 4.

The first portion 9 of the locking mechanism 5 preferably comprises a lug receptacle 13, and the mating portion 12 preferably comprises a lug 14, although the first portion 9 could equally well be the lug 14 with the mating portion 12 being the lug receptacle 13. And, most preferably, there are two lug receptacles 13, designated the first lug receptacle 15 and the second lug receptacle 16, and two lugs 14, designated the first lug 17 and the second lug 18 (not illustrated), located such that rotating the inner shaft 4 in a first direction causes the first lug 17 to enter and be releasably frictionally retained by the first lug receptacle 15 as well as the second lug 18 to enter and be releasably frictionally retained by the second lug receptacle 16. Rotating the inner shaft 4 in the opposite direction causes the lug receptacles 15, 16 to release the lugs 17, 18. Also in the most preferred embodiment the two lug receptacles 13 are transversely opposed to one another, and the two lugs 14 are transversely opposed to one another. (There can, however, be any number of lugs 14 and lug receptacles 16, with the number of lug receptacles 16 preferably being the same as the number of lugs 14.)

Figure 5:
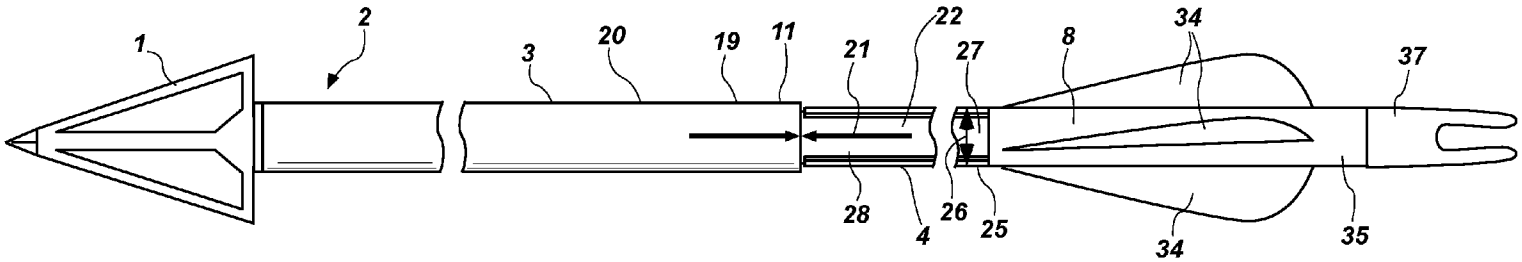
FIG. 5 illustrates the first longitudinal line, on the outer surface of the tube, aligned with the second longitudinal line, on the outer surface of the inner shaft, to show that the outer shaft and the inner shaft are properly locked together.

Preferably, a first longitudinal line 19 is created (using any technique that is known in the art, such as painting or etching) on the outer surface 20 of the outer shaft 3; and a second longitudinal line 21 is created (using any technique that is known in the art, such as painting or etching) on the outer surface 22 of the inner shaft 4 in such positions that, when the outer shaft 3 and the inner shaft 4 are properly locked together, the first longitudinal line 19 aligns with the second longitudinal line 21, as shown in FIG. 5.

Figure 4:
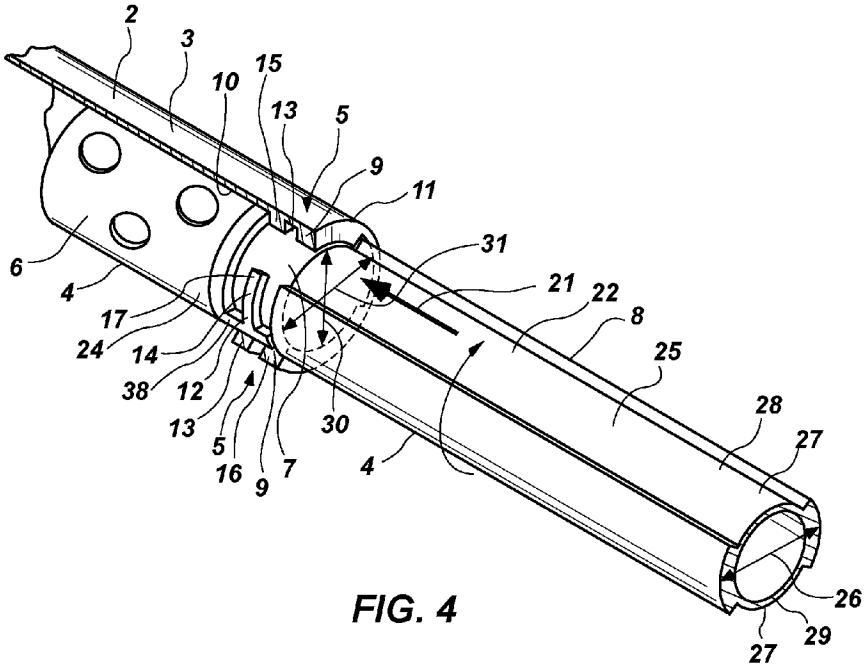
FIG. 4 is a perspective view of the Collapsible Arrow.
Figure 12:
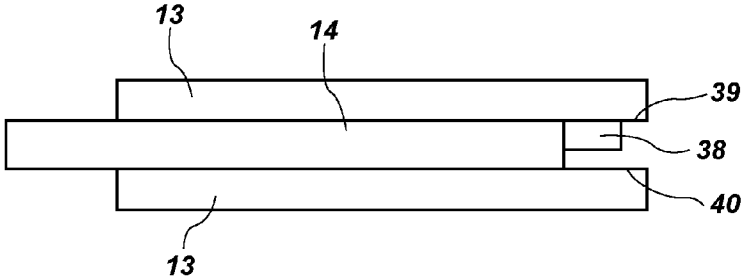
FIG. 12 shows a stop attached to a lug receptacle.
Figure 13:
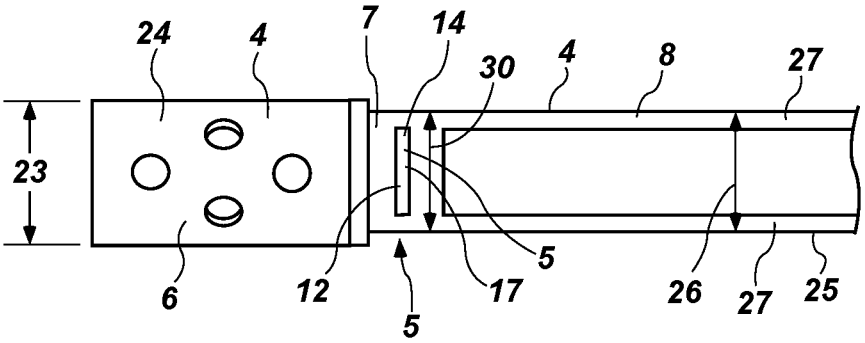
FIG. 13 depicts a lug having no attached stop.
Figure 14:
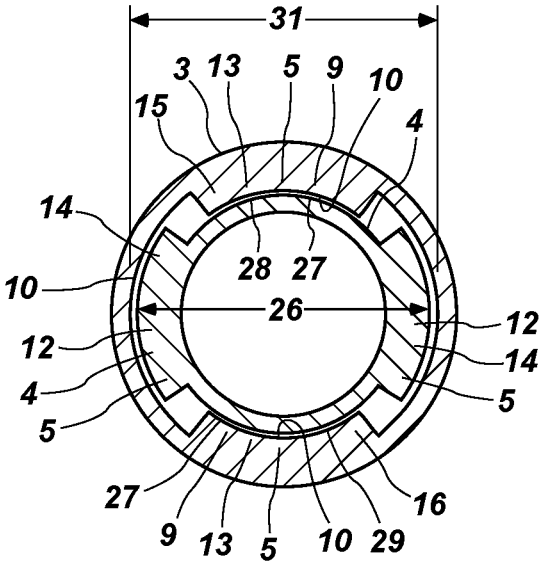
FIG. 14 is a cross-sectional view, from the rear, of an aft section having a wide portion.

And even more preferably, as illustrated in FIG. 4, a stop 38 is located along one or more of the lugs 14 at such a position as to terminate the rotation of the lug or lugs 14 into the lug receptacle 13 when the outer shaft 3 and the inner shaft 4 are properly locked together. Alternatively, as depicted in FIG. 12, a stop 38 could be attached to one or more lug receptacles 13 at such a position as to terminate the rotation of the lug or lugs 14 into the lug receptacle 13 when the outer shaft 3 and the inner shaft 4 are properly locked together. In such a case, the stop 38 would extend from a first interior wall 39 of the lug receptacle 13 toward a second interior wall 40 of the lug receptacle 13 sufficiently far to prevent further rotation of the lug 14 into the lug receptacle 13. Also in such a case, the stop 38 attached to the lug 14 could be retained for redundancy or eliminated as illustrated in FIG. 13.

In the preferred embodiment, the outer diameter 23 of at least a portion 24 of the forward section 6 of the inner shaft 4 is sufficiently large that such portion 24 cannot be moved aft past the first portion 9 of the locking mechanism 5. If any portion 25, designated the wide portion, of the aft section 8 of the inner shaft 4 has an outer diameter 26 which is so large (such as an outer diameter 26 of such a size that such portion 25 moves slidingly along the inside 10 of the outer shaft 3) that such portion 25 cannot be moved past the first portion 9 of the locking mechanism 5, one or more longitudinal channels 27 are formed in such portion 25 to accommodate the first portion 9 of the locking mechanism 5. For example, in the most preferred embodiment, a first longitudinal channel 28 in the wide portion 25 accommodates the first lug receptacle 15; and a second longitudinal channel 29 in the wide portion 25 accommodates the second lug receptacle 16.

(It should be noted that the wide portion 25 may, and most preferably does, as illustrated in FIG. 4, extend the full length of the aft section 8 of the inner shaft 4, although the longitudinal channels 27 preferably do not extend to the traditional aerodynamic stabilizers 34, when such stabilizers 34 are present.)

Figure 6:
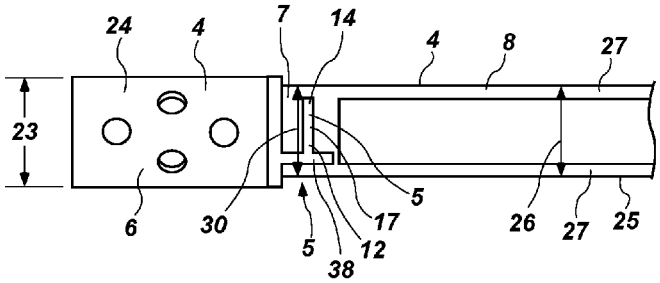
FIG. 6 is a lateral plan view concentrating upon the intermediate section of the inner shaft of the Collapsible Arrow.

Of course, the outer diameter 30 of the intermediate section 7 of the inner shaft 4 must, as depicted in FIG. 6, be sufficiently smaller than the inner diameter 31 of the outer shaft 3 to accommodate the locking mechanism 5. In the preferred embodiment this requires an outer diameter 30 for the intermediate section 7 of the inner shaft 4 of such size that each lug 14 and the corresponding lug receptacle 13 for such lug 14 can both be present and can be rotated together and apart.

Figure 7:
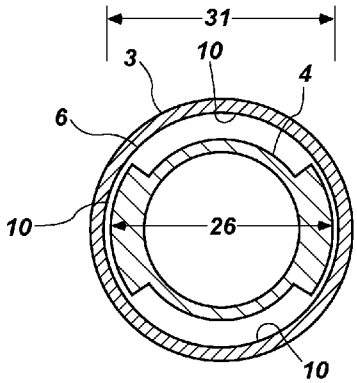
FIG. 7 illustrates the diameter of the entire forward section of the inner shaft being of such a size that the forward section moves slidingly along the inside of the outer shaft.

More preferably, the outer diameter 23 of at least a portion 24 of the forward section 6—and, most preferably, as illustrated in FIGS. 4 and 7, the outer diameter 23 of the entire forward section 6—of the inner shaft 4 is of such a size that such forward section 6 moves slidingly along the inside 10 of the outer shaft 3. This distributes stress along the forward section 6 while adding stability to the aft section 8 by reducing flexing of the aft section 8. The possibility of breakage is, consequently, reduced.

Figure 8:
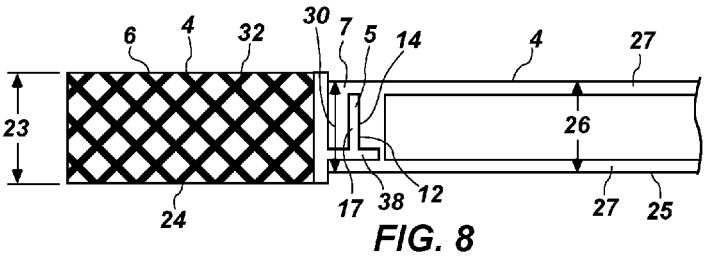
FIG. 8 shows the forward section of the inner shaft being a lattice structure.
Figure 9:
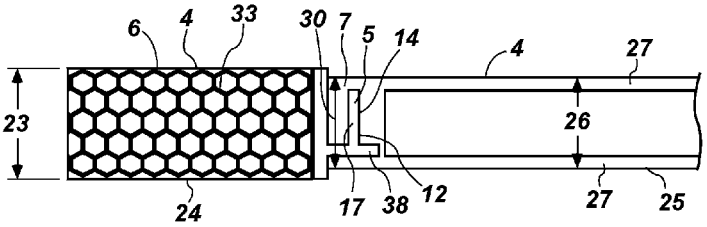
FIG. 9 depicts the forward section of the inner shaft being a honeycomb structure.

Optionally, any section 6, 7, 8 of the inner shaft 4 could be a lattice structure 32, as depicted in FIG. 8, or a honeycomb structure 33, as portrayed in FIG. 9 for the forward section 6 of the inner shaft 4.

Figure 10:
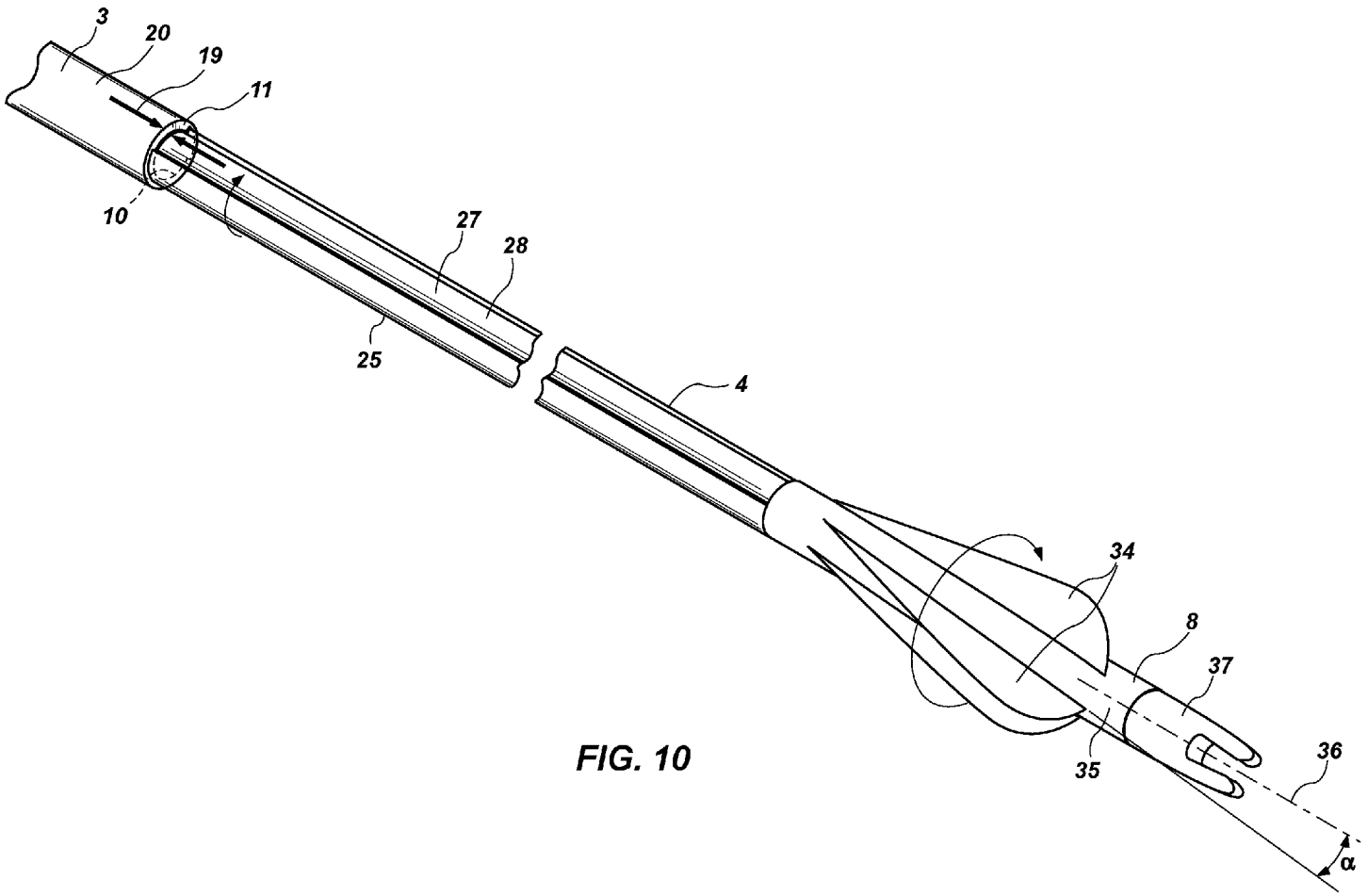
FIG. 10 portrays an aerodynamic stabilizer on the aft section of the inner shaft oriented at an angle to the longitudinal axis of the inner shaft in order, when the Collapsible Arrow is in flight, to tend to rotate each lug farther into its mating lug receptacle.
Figure 11:
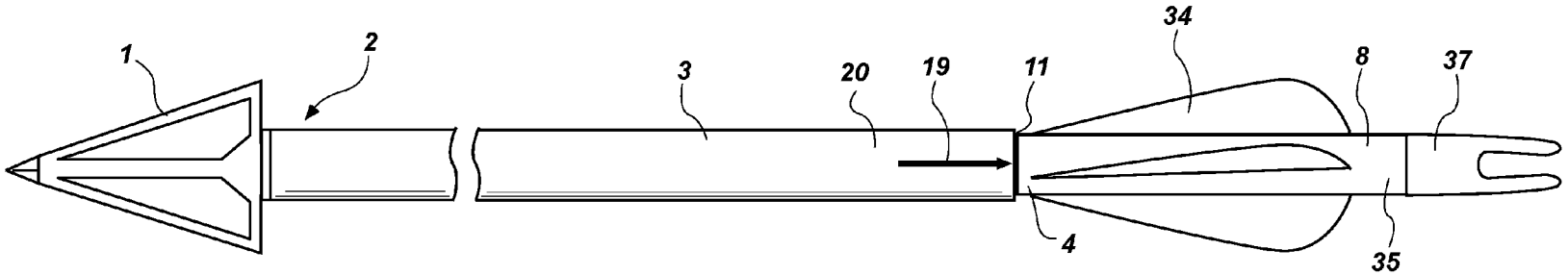
FIG. 11 illustrates the traditional aerodynamic stabilizer remaining outside the outer shaft even when the inner shaft has been retracted into the outer shaft.

Furthermore, two or more traditional aerodynamic stabilizers 34, also termed vanes or fletching (individually, designated a fletch), such as feathers, are preferably permanently or removably fixedly located on the outer surface 22 of the aft section 8 of the inner shaft 4, preferably near the free (rear) end 35 of the aft section 8 of the inner shaft 4. Preferably, as illustrated in FIG. 10, each stabilizer 34 is oriented at an angle $\alpha$ to the longitudinal axis 36 of the inner shaft 4 in order, when the Collapsible Arrow is in flight through a fluid medium, such as air, to rotate the inner shaft 4, and, consequently, each lug 14 farther into its mating lug receptacle 13. When at least one fletch 34, and, preferably, each fletch 34 is a feather, the angle $\alpha$ can be zero because feather fletches 34 impart a natural spin on an arrow due to the rough and smooth sides of a feather and the natural curve, determined by from which wing the feather came. And when a traditional aerodynamic stabilizer 34 is employed, the inner shaft 4 is preferably selected to be of such a length that the aerodynamic stabilizer 34 remains outside the outer shaft 3 even when the inner shaft 4 is retracted into the outer shaft 3 as shown in FIG. 11. Thus, any longitudinal channel 27 need not extend so far as to the traditional aerodynamic stabilizers 34. And saying that the traditional aerodynamic stabilizers 34 are located to produce rotation of each lug 14 farther into its mating lug receptacle 13 is herein defined to include both such rotation produced by the traditional aerodynamic stabilizer 34 being oriented at a non-zero angle $\alpha$ and such rotation being produced by the traditional aerodynamic stabilizer 34 being a feather.

Preferably, the Collapsible Arrow is constructed of a carbon fiber composite or of aluminum.

As used herein the term "preferable" or "preferably" means that a specified element or technique is more acceptable than another but not that such specified element or technique is a necessity.

I claim:

1. A collapsible arrow, which comprises:

an outer shaft having a forward end, an inside, an inner diameter, and an aft end;

an arrow head attached to the forward end of said outer shaft;

an inner shaft, comprising a forward section having an outer diameter, an intermediate section having an outer diameter, and an aft section with an outer surface, with a rear end, and with a longitudinal axis, said inner shaft retracting into said outer shaft for storage and said inner shaft extending from said outer shaft for shooting;

a means for locking the position of said inner shaft with respect to the outer shaft without, when unlocked, obstructing any desired longitudinal movement of the intermediate section and the aft section with respect to said outer shaft, said means for locking having minimal aerodynamic impact; and a nock attached to the rear end of the aft section of said inner shaft.

2. The collapsible arrow as recited in claim 1, wherein:

the diameter of at least a portion of the forward section of said inner shaft is of such a size that such forward section of said inner shaft moves slidingly along the inside of said outer shaft.

3. The collapsible arrow as recited in claim 2, wherein:

at least a portion of the aft section of said inner shaft has an outer diameter sufficiently large to move slidingly along the inside of said outer shaft.

4. The collapsible arrow as recited in claim 2, wherein:

the entire aft section of said inner shaft has an outer diameter sufficiently large to move slidingly along the inside of said outer shaft.

5. The collapsible arrow as recited in claim 2, wherein:

the aft section of said inner shaft has no portion having an outer diameter sufficiently large to move slidingly along the inside of said outer shaft.

6. The collapsible arrow as recited in claim 2, wherein:

said means for locking the position of said inner shaft with respect to the outer shaft without, when unlocked, obstructing any desired longitudinal movement of the intermediate section and the aft section with respect to said outer shaft, said means for locking having minimal aerodynamic impact, comprises:

at least one lug connected to the intermediate section of said inner shaft; and at least one lug receptacle attached to the inside of said outer shaft near an aft end of said outer shaft for each lug, the lug receptacle for each such lug being located so that rotating said inner shaft in a first direction causes each such lug to enter and be releasably frictionally retained within the lug receptacle for such lug and rotating said inner shaft in the direction opposite to the first direction causes such lug receptacle for such lug to release such lug, the outer diameter of the intermediate section of said inner shaft being sufficiently smaller than the inner diameter of said outer shaft that each such lug and each such corresponding lug receptacle can be present and can be rotated together and apart.

7. The collapsible arrow as recited in claim 6, wherein:

at least a portion of the aft section of said inner shaft has an outer diameter sufficiently large to move slidingly along the inside of said outer shaft, such portion of the aft section containing, for each lug receptacle, a longitudinal channel to accommodate such lug receptacle.

8. The collapsible arrow as recited in claim 6, wherein:

the entire aft section of said inner shaft has an outer diameter sufficiently large to move slidingly along the inside of said outer shaft, the aft section containing, for each lug receptacle, a longitudinal channel to accommodate such lug receptacle.

9. The collapsible arrow as recited in claim 6, wherein:

the aft section of said inner shaft has no portion having an outer diameter sufficiently large to move slidingly along the inside of said outer shaft.

10. The collapsible arrow as recited in claim 2, further comprising:

two or more traditional aerodynamic stabilizers located on the outer surface of the aft section of the inner shaft oriented to rotate said inner shaft when the collapsible arrow is in flight through a fluid medium such as air.

11. The collapsible arrow as recited in claim 10, wherein:

at least a portion of the aft section of said inner shaft has an outer diameter sufficiently large to move slidingly along the inside of said outer shaft.

12. The collapsible arrow as recited in claim 10, wherein:

the entire aft section of said inner shaft has an outer diameter sufficiently large to move slidingly along the inside of said outer shaft.

13. The collapsible arrow as recited in claim 10, wherein:

the aft section of said inner shaft has no portion having an outer diameter sufficiently large to move slidingly along the inside of said outer shaft.

14. The collapsible arrow as recited in claim 10, wherein:

said means for locking the position of said inner shaft with respect to the outer shaft without, when unlocked, obstructing any desired longitudinal movement of the intermediate section and the aft section with respect to said outer shaft, said means for locking having minimal aerodynamic impact, comprises:

at least one lug connected to the intermediate section of said inner shaft; and at least one lug receptacle attached to the inside of said outer shaft near an aft end of said outer shaft for each lug, the lug receptacle for each such lug being located so that rotating said inner shaft in a first direction causes each such lug to enter and be releasably frictionally retained within the lug receptacle for such lug and rotating said inner shaft in the direction opposite to the first direction causes such lug receptacle for such lug to release such lug, the outer diameter of the intermediate section of said inner shaft being sufficiently smaller than the inner diameter of said outer shaft that each such lug and each such corresponding lug receptacle can be present and can be rotated together and apart; and wherein:

the location of said traditional aerodynamic stabilizers produces rotation of each said lug farther into the mating lug receptacle for each said lug.

15. The collapsible arrow as recited in claim 14, wherein:

at least a portion of the aft section of said inner shaft has an outer diameter sufficiently large to move slidingly along the inside of said outer shaft, such portion of the aft section containing, for each lug receptacle, a longitudinal channel to accommodate such lug receptacle, such longitudinal channel not extending so far as to the traditional aerodynamic stabilizers.

16. The collapsible arrow as recited in claim 14, wherein:

the entire aft section of said inner shaft has an outer diameter sufficiently large to move slidingly along the inside of said outer shaft, the aft section containing, for each lug receptacle, a longitudinal channel to accommodate such lug receptacle, such longitudinal channel not extending so far as to the traditional aerodynamic stabilizers.

17. The collapsible arrow as recited in claim 14, wherein:

the aft section of said inner shaft has no portion having an outer diameter sufficiently large to move slidingly along the inside of said outer shaft.

18. The collapsible arrow as recited in claim 1, further comprising:

two or more traditional aerodynamic stabilizers located on the outer surface of the aft section of the inner shaft oriented to rotate said inner shaft when the collapsible arrow is in flight through a fluid medium such as air.

19. The collapsible arrow as recited in claim 18, wherein:

at least a portion of the aft section of said inner shaft has an outer diameter sufficiently large to move slidingly along the inside of said outer shaft.

20. The collapsible arrow as recited in claim 18, wherein:

the entire aft section of said inner shaft has an outer diameter sufficiently large to move slidingly along the inside of said outer shaft.

21. The collapsible arrow as recited in claim 18, wherein:

the aft section of said inner shaft has no portion having an outer diameter sufficiently large to move slidingly along the inside of said outer shaft.

22. The collapsible arrow as recited in claim 18, wherein:

said means for locking the position of said inner shaft with respect to the outer shaft without, when unlocked, obstructing any desired longitudinal movement of the intermediate section and the aft section with respect to said outer shaft, said means for locking having minimal aerodynamic impact, comprises:

at least one lug connected to the intermediate section of said inner shaft; and at least one lug receptacle attached to the inside of said outer shaft near an aft end of said outer shaft for each lug, the lug receptacle for each such lug being located so that rotating said inner shaft in a first direction causes each such lug to enter and be releasably frictionally retained within the lug receptacle for such lug and rotating said inner shaft in the direction opposite to the first direction causes such lug receptacle for such lug to release such lug, the outer diameter of the intermediate section of said inner shaft being sufficiently smaller than the inner diameter of said outer shaft that each such lug and each such corresponding lug receptacle can be present and can be rotated together and apart; and wherein:

the location of said traditional aerodynamic stabilizers produces rotation of each said lug farther into the mating lug receptacle for each said lug.

23. The collapsible arrow as recited in claim 22, wherein:

at least a portion of the aft section of said inner shaft has an outer diameter sufficiently large to move slidingly along the inside of said outer shaft, such portion of the aft section containing, for each lug receptacle, a longitudinal channel to accommodate such lug receptacle, such longitudinal channel not extending so far as to the traditional aerodynamic stabilizers.

24. The collapsible arrow as recited in claim 22, wherein:

the entire aft section of said inner shaft has an outer diameter sufficiently large to move slidingly along the inside of said outer shaft, the aft section containing, for each lug receptacle, a longitudinal channel to accommodate such lug receptacle, such longitudinal channel not extending so far as to the traditional aerodynamic stabilizers.

25. The collapsible arrow as recited in claim 22, wherein:

the aft section of said inner shaft has no portion having an outer diameter sufficiently large to move slidingly along the inside of said outer shaft.

26. A collapsible arrow, which comprises:

an outer shaft having a forward end, an inside, an inner diameter, and an aft end;

an arrow head attached to the forward end of said outer shaft;

an inner shaft, comprising a forward section having an outer diameter, an intermediate section having an outer diameter, and an aft section with an outer surface, with a rear end, and with a longitudinal axis, said inner shaft retracting into said outer shaft for storage and said inner shaft extending from said outer shaft for shooting, wherein the diameter of at least a portion of the forward section of said inner shaft is of such a size that such forward section of said inner shaft moves slidingly along the inside of said outer shaft;

at least one lug connected to the intermediate section of said inner shaft;

at least one lug receptacle attached to the inside of said outer shaft near an aft end of said outer shaft for each lug, the lug receptacle for each such lug being located so that rotating said inner shaft in a first direction causes each such lug to enter and be releasably frictionally retained within the lug receptacle for such lug and rotating said inner shaft in the direction opposite to the first direction causes such lug receptacle for such lug to release such lug, the outer diameter of the intermediate section of said inner shaft being sufficiently smaller than the inner diameter of said outer shaft that each such lug and each such corresponding lug receptacle can be present and can be rotated together and apart; and a nock attached to the rear end of the aft section of said inner shaft.

27. A collapsible arrow, which comprises:

an outer shaft having a forward end, an inside, an inner diameter, and an aft end;

an arrow head attached to the forward end of said outer shaft;

an inner shaft, comprising a forward section having an outer diameter, an intermediate section having an outer diameter, and an aft section with an outer surface, with a rear end, and with a longitudinal axis, said inner shaft retracting into said outer shaft for storage and said inner shaft extending from said outer shaft for shooting, wherein the diameter of at least a portion of the forward section of said inner shaft is of such a size that such forward section of said inner shaft moves slidingly along the inside of said outer shaft;

two or more traditional aerodynamic stabilizers located on the outer surface of the aft section of the inner shaft oriented to rotate said inner shaft when the collapsible arrow is in flight through a fluid medium such as air;

at least one lug connected to the intermediate section of said inner shaft;

at least one lug receptacle attached to the inside of said outer shaft near an aft end of said outer shaft for each lug, the lug receptacle for each such lug being located so that rotating said inner shaft in a first direction causes each such lug to enter and be release frictionally retained within the lug receptacle for such lug and rotating said inner shaft in the direction opposite to the first direction causes such lug receptacle for such lug to release such lug, the outer diameter of the intermediate section of said inner shaft being sufficiently smaller than the inner diameter of said outer shaft that each such lug and each such corresponding lug receptacle can be present and can be rotated together and apart; and a nock attached to the rear end of the aft section of said inner shaft.

28. A collapsible arrow, which comprises:

an outer shaft having a forward end, an inside, an inner diameter, and an aft end;

an arrow head attached to the forward end of said outer shaft;

an inner shaft, comprising a forward section having an outer diameter, an intermediate section having an outer diameter, and an aft section with an outer surface, with a rear end, and with a longitudinal axis, said inner shaft retracting into said outer shaft for storage and said inner shaft extending from said outer shaft for shooting;

two or more traditional aerodynamic stabilizers located on the outer surface of the aft section of the inner shaft oriented to rotate said inner shaft when the collapsible arrow is in flight through a fluid medium such as air;

at least one lug connected to the intermediate section of said inner shaft;

at least one lug receptacle attached to the inside of said outer shaft near an aft end of said outer shaft for each lug, the lug receptacle for each such lug being located so that rotating said inner shaft in a first direction causes each such lug to enter and be releasably frictionally retained within the lug receptacle for such lug and rotating said inner shaft in the direction opposite to the first direction causes such lug receptacle for such lug to release such lug, the outer diameter of the intermediate section of said inner shaft being sufficiently smaller than the inner diameter of said outer shaft that each such lug and each such corresponding lug receptacle can be present and can be rotated together and apart; and a nock attached to the rear end of the aft section of said inner shaft.

* * * * *